US010272700B2

(12) United States Patent
Singla et al.

(10) Patent No.: US 10,272,700 B2
(45) Date of Patent: Apr. 30, 2019

(54) DETECTING MISALIGNMENT

(71) Applicant: Hewlett-Packard Development Company, L.P., Houston, TX (US)

(72) Inventors: Joan Singla, Barcelona (ES); Gianni Cessel, Barcelona (ES); Guido Charosky, Barcelona (ES); Francesc Roure Pastor, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,572

(22) PCT Filed: Oct. 30, 2015

(86) PCT No.: PCT/EP2015/075325
§ 371 (c)(1),
(2) Date: Jan. 29, 2018

(87) PCT Pub. No.: WO2017/071778
PCT Pub. Date: May 4, 2017

(65) Prior Publication Data
US 2018/0222217 A1 Aug. 9, 2018

(51) Int. Cl.
*B41J 29/42* (2006.01)
*B41J 11/00* (2006.01)
(Continued)

(52) U.S. Cl.
CPC ..... *B41J 11/008* (2013.01); *B41J 29/393* (2013.01); *B65H 37/06* (2013.01); *B65H 45/12* (2013.01);
(Continued)

(58) Field of Classification Search
CPC ..... B41J 11/008; B41J 29/393; B41J 29/42; B65H 37/06; B65H 2557/61; G03G 2215/00877; G03G 2215/00594
(Continued)

(56) References Cited

U.S. PATENT DOCUMENTS 6,273,313 B1 8/2001 Noll et al.
7,486,410 B2 2/2009 Hisamura
(Continued)

FOREIGN PATENT DOCUMENTS

EP 1185476 3/2002
WO 0073186 12/2000

OTHER PUBLICATIONS

Berger, A. et al., "Paper Folding Device," Jun. 10, 2009, retrieved from the intemet [https://www.ohio.edu/mechanical/design/SrD08_09/T2_FinalDesignReport.pdf], 105 pages.
(Continued)

*Primary Examiner* — Jamares Q Washington
(74) *Attorney, Agent, or Firm* — HP Inc. Patent Department

(57) ABSTRACT

Examples of a method for detecting misalignment cause a printer to print a calibration pattern on a recording medium sheet. The calibration pattern includes graduated measurement scales positioned so that: when the calibration pattern is printed without misalignment on a recording medium sheet of predetermined dimensions, matching graduations of plural measurement scales in the calibration pattern are printed at respective reference locations on the recording medium sheet that correspond to corners of the recording medium sheet (or to spaced positions along a line where folding of the recording medium sheet by a folding apparatus is intended to take place). When the calibration pattern is printed with misalignment on a recording medium sheet of
(Continued)

predetermined dimensions, non-matching graduations of the plural measurement scales are printed at the reference locations on the recording medium sheet.

14 Claims, 5 Drawing Sheets

(51) Int. Cl.

| | |
|---|---|
| ***G03G 15/00*** | (2006.01) |
| ***B65H 37/06*** | (2006.01) |
| ***B41J 29/393*** | (2006.01) |
| ***B65H 45/12*** | (2006.01) |

(52) U.S. Cl.
CPC ..... *G03G 15/6582* (2013.01); *B65H 2402/10* (2013.01); *B65H 2557/61* (2013.01); *B65H 2801/27* (2013.01); *G03G 2215/00569* (2013.01); *G03G 2215/00877* (2013.01)

(58) Field of Classification Search
USPC ..... 358/1.12, 1.18; 382/112; 347/116
See application file for complete search history.

(56) References Cited

U.S. PATENT DOCUMENTS

| | | | | |
|---|---|---|---|---|
| 7,926,800 | B2 | 4/2011 | Oikawa et al. | |
| 8,922,853 | B2 | 12/2014 | Wilen | |
| 2002/0136579 | A1* | 9/2002 | Michel | B41J 11/008 400/74 |
| 2004/0259709 | A1 | 12/2004 | Guidotti et al. | |
| 2010/0103447 | A1* | 4/2010 | Gurr, Jr. | B41J 29/393 358/1.15 |
| 2013/0244848 | A1 | 9/2013 | Tobishima | |
| 2013/0293902 | A1* | 11/2013 | Seto | H04N 1/3873 358/1.5 |
| 2014/0255127 | A1 | 9/2014 | Yamaguchi | |

OTHER PUBLICATIONS

International Searching Authority, "Search Report," issued in connection with PCT patent application No. PCT/EP/2015/075325, dated Jul. 27, 2016, 3 pages.
International Searching Authority, "Written Opinion," issued in connection with PCT patent application No. PCT/EP/20151075325, dated Jul. 27, 2016, 6 pages.
Alex Berger et al., "Paper Folding Device," dated Jun. 10, 2009, 105 pages.

* cited by examiner

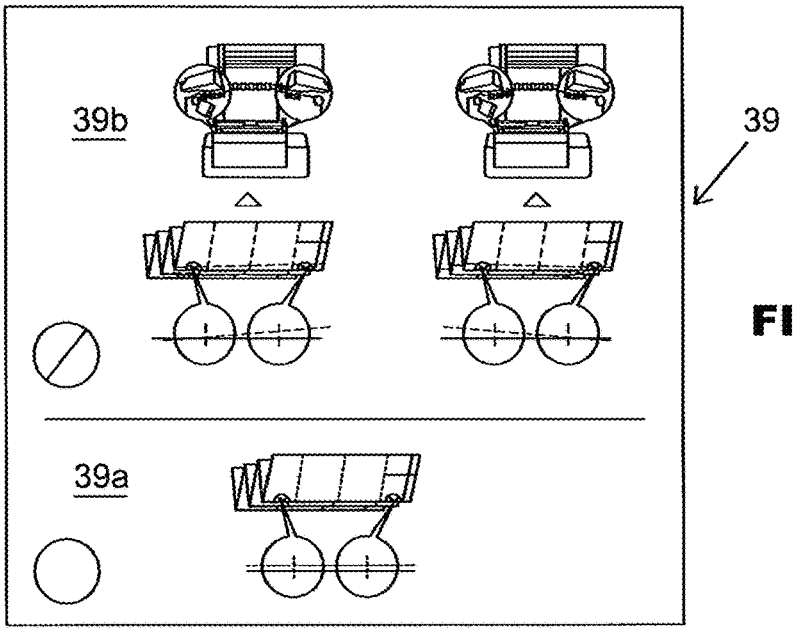
FIG.6A
FIG.6B
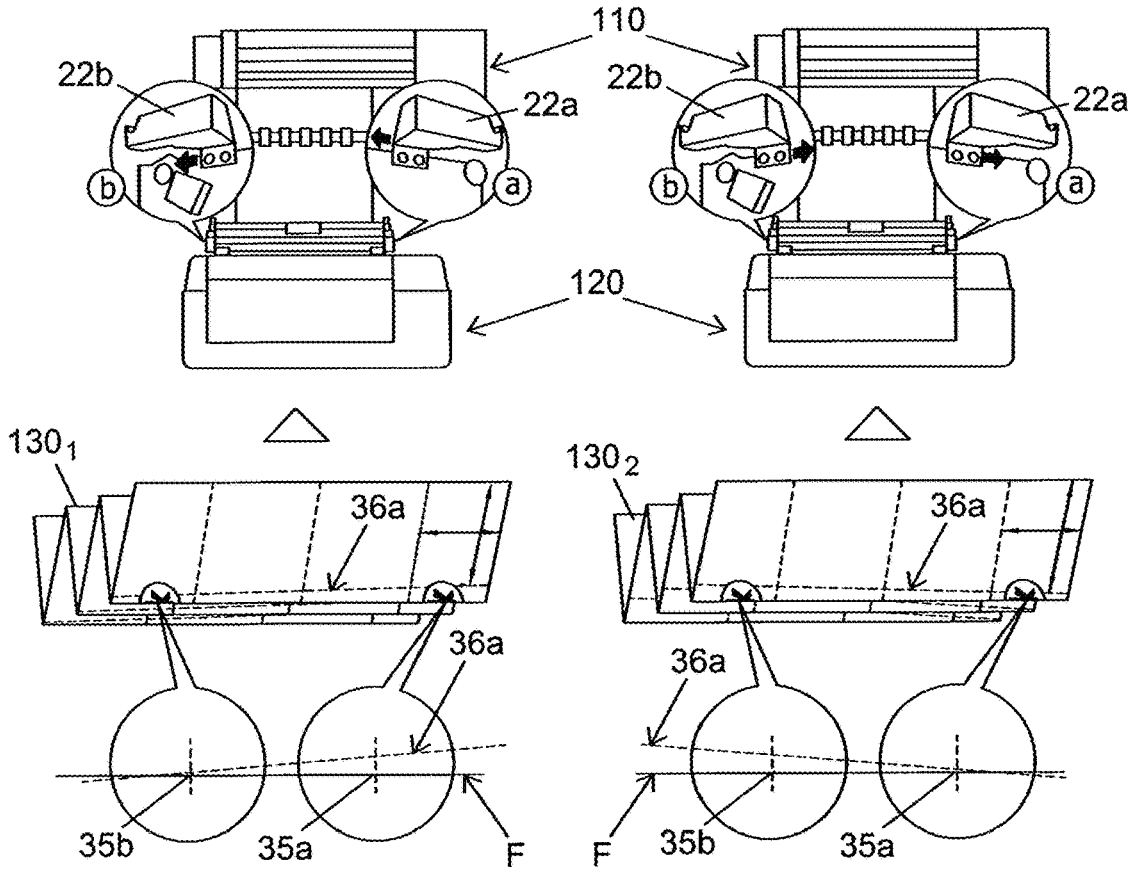

DETECTING MISALIGNMENT

BACKGROUND

The quality of the output of a system that includes a printer can be affected detrimentally by misalignments of various kinds.

It is to be understood that in the present document the expression "printer" designates substantially any printing device that can form an image on a recording medium—for example laser printers, inkjet printers, plotters, and so on—irrespective of whether the device has additional functions (e.g. copying, fax transmission, and so on) and irrespective of whether the device prints in black and white or colour. Further, it is to be understood that in the present document the expression "recording medium" designates substantially any support upon which a printing device can print: for example, paper (in sheet or web form), cardboard, photographic media, and so on.

BRIEF DESCRIPTION OF THE DRAWINGS

The following detailed description references the drawings, wherein:

FIG. 6A is an enlarged view of a diagnosis-and-adjustment graphic included in the calibration pattern of FIG. 3, and FIG. 6B is an enlarged view of a portion of the diagnosis-and-adjustment graphic;

DETAILED DESCRIPTION

The present disclosure provides examples of methods for detection of misalignment in a system that includes a printer, for example in a system (such as system 5 mentioned below) that comprises a printer and a folding apparatus that is arranged to fold recording media sheets output from the printer. In view of the fact that the structure and functioning of printers and folding apparatus are well-known, the present document excludes explanation that is not germane to understanding the invention, It is often the case that a printer is used in conjunction with a folding apparatus. (In a so-called "on-line" arrangement the folding apparatus receives the recording media sheets as they are output by the printer, and folds them. In an "off-line" arrangement the folding apparatus may receive printed output for folding, for example by manual feeding.) The quality of the output of a system that includes a printer and a folding apparatus arranged to fold output from the printer likewise can be affected detrimentally by misalignments, for example:

- misalignment between the printer and the folding apparatus,
- printer skew (i.e. misalignment between the printer and the recording medium),
- folding skew (i.e. angular misalignment between intended and actual fold positions), and
- misalignments that lead to incorrect width and/or length of the folded package.

Figure 1:
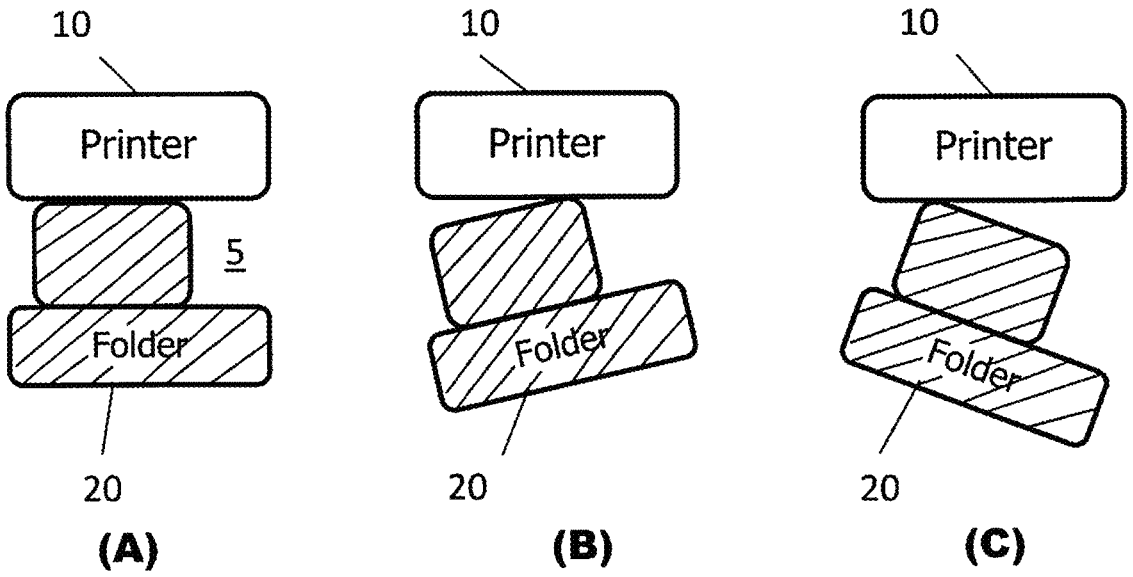
FIG. 1 is a diagram schematically illustrating misalignment between a printer and a folding apparatus, in which image (A) represents correct alignment of the printer with the folding apparatus, and images (B) and (C) represent angular misalignment of the folding apparatus relative to the printer.

FIG. 1 is a diagram to illustrate the problem of misalignment between a printer 10 and a folding apparatus 20. In the examples represented in FIG. 1 the printer 10 and the folding apparatus 20 form part of a system 5 that is intended for online operation so that recording media sheets printed by printer 10 are fed to and automatically folded by folding apparatus 20. Image (A) shown in FIG. 1 illustrates correct alignment between the printer 10 and folding apparatus 20. However, the folding apparatus may be in a position (as illustrated in image (B) of FIG. 1) that is rotated counterclockwise relative to the orientation that would give correct alignment with the printer. Further, the folding apparatus may be in a position (as illustrated in image (C) of FIG. 1) that is rotated clockwise relative to the orientation that would give correct alignment with the printer.

Although not illustrated in FIG. 1, it will be understood that misalignment between the printer 10 and the folding apparatus 20 may involve translation of the folding apparatus 20 to the right or left relative to position of correct alignment with the printer 10. Further, it will be understood that misalignment between the printer 10 and folding apparatus 20 can arise from incorrect positioning of either or both of the printer 10 and folding apparatus 20.

Printer skew is misalignment between the printer and the recording medium such that printed images are not located correctly on the printed recording medium (e.g. the image is at an angle or translated relative to the intended position). Printer skew can arise for various reasons including, for example, incorrect alignment of the transport mechanism conveying recording media through the printer, incorrect alignment/operation of the printing module, and so on. In many cases parameters in the printer may be adjusted to correct printer skew.

Likewise, in many cases parameters in the folding apparatus may be adjusted to correct folding skew (i.e. angular misalignment between intended and actual fold positions), and misalignments that lead to incorrect width and/or length of the recording medium after folding.

However, adjustment of misalignment presupposes that the misalignment can be detected.

Figure 2:
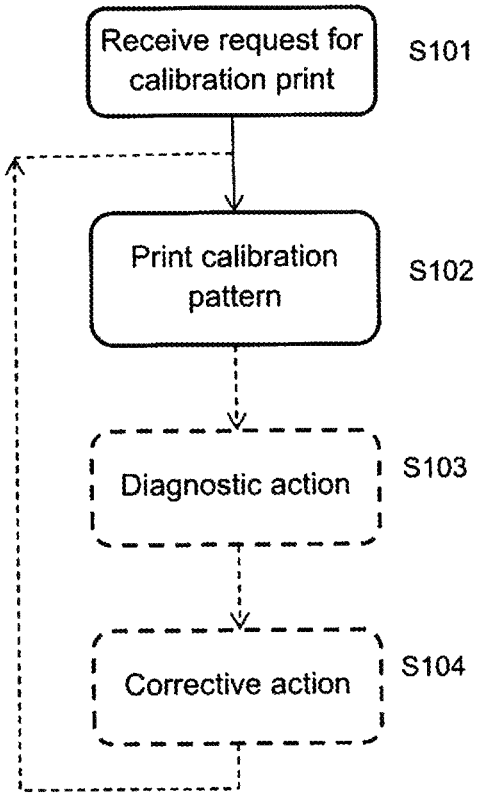
FIG. 2 is a flow diagram illustrating an example method of detecting misalignment.

FIG. 2 is a flow diagram that illustrates an example method for detecting misalignment in a system that comprises a printer and a folding apparatus that is arranged to fold recording media sheets output from the printer.

The method of FIG. 2 comprises receiving, at the printer, a request to print a calibration pattern on a recording medium (S101 in FIG. 2), and, in response to the request, printing an image of the calibration pattern on a recording medium sheet (S102 in FIG. 2). If desired, the method of FIG. 2 may also include performing a diagnosis of misalignment based on the printed image of the calibration pattern (S103). If desired, the method of FIG. 2 may also include taking corrective action (S104 in FIG. 2) based on the result of the diagnosis. Furthermore, after corrective action has been taken the calibration pattern may be printed again to check that the previous misalignment has been eliminated.

Before looking in greater detail at calibration patterns that may be used in the method of FIG. 2 it is appropriate to remark that:

the printer may receive the request to print the calibration pattern in various ways including, but not limited to: receipt of a user instruction requesting printing of the calibration pattern, receipt of an automatically-generated request (e.g. generated by diagnostic software or firmware of the printer), receipt of a request from an external source via a wired or wireless communications interface, and so on. In the case of receipt of a user instruction this instruction may be communicated to the printer in any convenient manner (e.g. by operation of a graphical user interface or controls provided on the printer, by use of a remote control, etc.).

when installing a printer and a folding apparatus in juxtaposition to each other it may be appropriate to run the method of FIG. 2 in order to arrive at a correct alignment of the devices relative to one another and then to fix the devices in the position of correct alignment. Thereafter it may be appropriate to run the method of FIG. 2 as part of a trouble-shooting process when problems arise.

the method of FIG. 2 is suitable for use in systems that incorporate printers that have sheet feeders for supplying recording media sheets to be printed and in systems that incorporate printers associated with recording media provided on rolls (where a cutting mechanism cuts recording media sheets from the roll). In the case where the printer is associated with a cutting mechanism for cutting off recording media sheets on which printing will be performed, the method of FIG. 2 may additionally enable cutting errors to be detected (as explained below).

Figure 3:
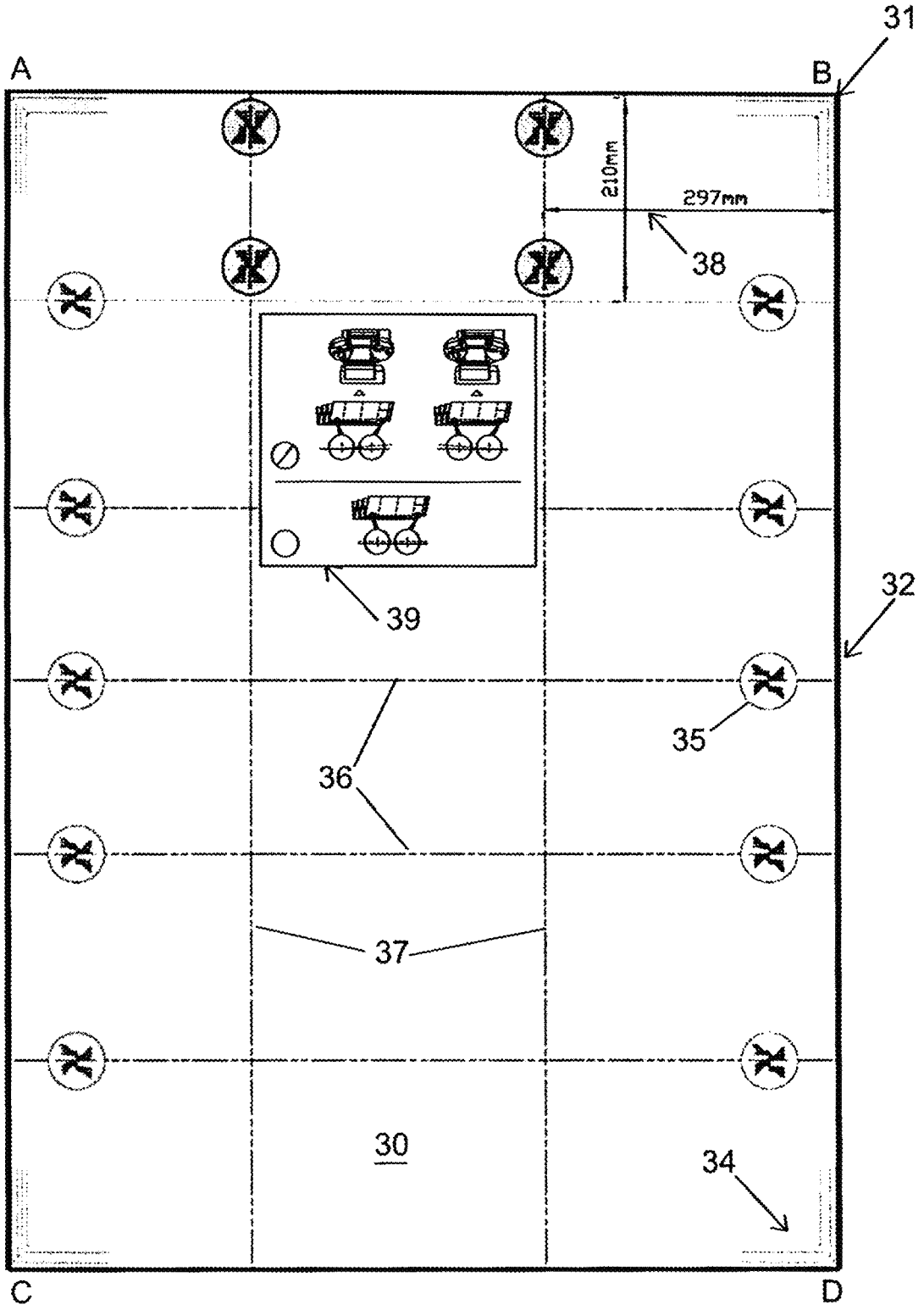
FIG. 3 is a representation of an example calibration pattern that may be used in the method according to FIG. 2.

FIG. 3 illustrates an example of a calibration pattern 30 that may be used in the method of FIG. 2. Although FIG. 3 shows lines 32 that indicate the edges of the calibration pattern 30, and points 31 that indicate the corners of the calibration pattern 30, it is to be understood that the calibration pattern does not necessarily include markings to be printed to define these edge and corner positions (i.e. the illustrated lines 32 and points 31 are indicated in FIG. 3 primarily to facilitate the following explanation).

It will be seen that the calibration pattern 30 of FIG. 3 includes some graduated measurement scales (for example, elements 34 and 35 described below). These graduated measurement scales are positioned so that when the calibration pattern is printed, without misalignment, on a recording medium sheet of predetermined dimensions, matching graduations of plural measurement scales in the calibration pattern are printed at respective reference locations on the recording medium sheet. The reference locations in question correspond to corners of the recording medium sheet or to spaced positions along a line where folding of the recording medium sheet is to take place. When the calibration pattern is printed on the recording medium sheet of predetermined dimensions, and there is misalignment, non-matching graduations of plural measurement scales are printed at the reference locations on the recording medium sheet.

Accordingly, misalignment in the system may be detected by determining which graduations of corresponding measurement scales in the calibration pattern are in registration with each of two (or more) reference positions on the recording medium sheet and comparing these graduations with each other. If the alignment is correct then the graduations determined for the different reference points will "match" (e.g. two reference points will be in registration with graduations that take the same value on their respective measurement scales). This point is described in greater detail below.

In the example of FIG. 3 the calibration pattern includes plural measurement scales (34, 35) of different types and plural instances of each type of measurement scale. More specifically, in this example the calibration pattern 30 includes plural first measurement scales 34 that are located at corners of the calibration pattern, and plural second measurement scales 35 that are located at spaced positions along lines that correspond to places where a recording medium sheet of predetermined dimensions is expected to be folded (e.g. by a folding apparatus 20 arranged to be used with the printer 10 printing the calibration pattern).

In the example of FIG. 3 the calibration pattern 30 is designed to be printed on a recording medium sheet that is expected to be folded along fan-fold lines whose positions correspond to lines 36 indicated in FIG. 3 and then the fan-folded sheet is intended to be further forded along cross-fold lines whose positions correspond to lines 37 indicated in FIG. 3. In the example illustrated in FIG. 3, a pair of second measurement scales 35 is provided on each of the lines 36 that correspond to the position of fanfolds and on each of the lines 37 that correspond to cross folds. On each of the lines 36, 37 that correspond to folding lines, the pair of second measurement scales 35 are positioned at respective points that are spaced apart along the respective line (in this example they are positioned close to the extremities of the respective lines).

In the example illustrated in FIG. 3 the calibration pattern includes dashed lines at the positions indicated by the lines 36 and 37, but it is permissible to dispense with any markings to indicate the fold-line positions of lines 36, 37 (i.e. the calibration pattern may be free from lines marked at the positions 36, 37).

In certain implementations the calibration pattern does include markings to indicate the positions of the intended fold lines. This makes it possible for a user to make a rough check of whether or not there are folding problems, based on whether a recording medium sheet that is printed with an image of the calibration pattern, and then folded, has folds at positions that coincide with the fold-line markings in the calibration pattern.

In the example illustrated in FIG. 3 the calibration pattern is intended to be printed on a recording medium sheet whose size is DIN A0 and this sheet is intended to be folded down to a package size that corresponds to DIN A4. The calibration pattern 30 includes dimension marks 38 which indicate the length and width dimensions of the final folded size in terms of numerical values. The dimension marks 38 make it particularly simple for a user to see whether the dimensions of the folded output (folded width and length) match the intended dimensions indicated in the calibration pattern.

As indicated above, the example calibration pattern 30 is intended to be printed on a recording medium sheet of a predetermined size (A0 in the example of FIG. 3). The calibration pattern could be printed on a sheet of different size—smaller, larger, or having a different aspect ratio—but in that case certain measurement scale graduations may no longer have the desired positioning relative to the corners, edges or fold lines of the recording medium sheet and so may not contribute to detection of misalignment.

The calibration sheet 30 illustrated in FIG. 3 includes a reference graphic 39 that indicates in pictorial fashion how relative misalignment between a printer and a folding apparatus can be determined based on a comparison of the relative positions between two reference positions on a recording medium sheet that bears an image of the calibration pattern and two instances of the second measurement scale (as discussed below).

Figure 4:
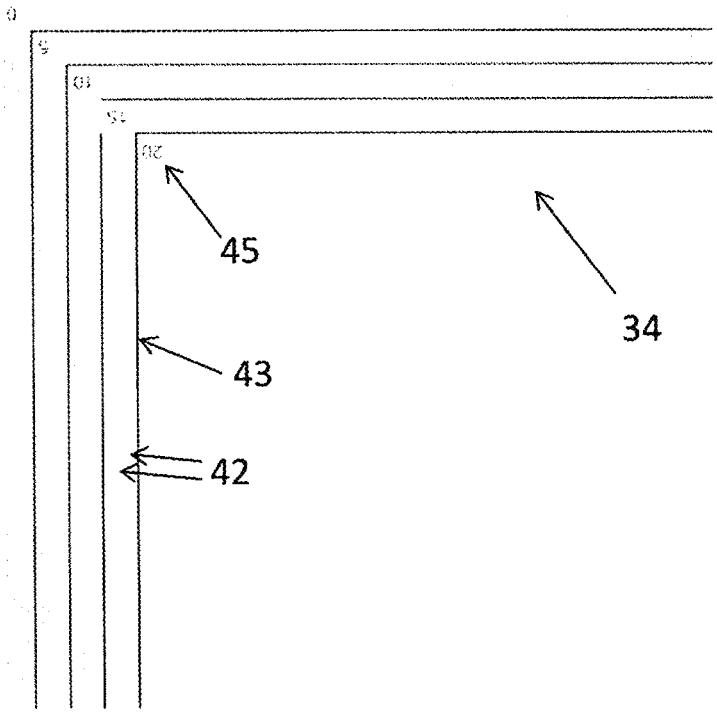
FIG. 4 is an enlarged view of a first measurement scale included in the calibration pattern of FIG. 3.

FIG. 4 is an enlarged view of a first measurement scale 34 used in the example calibration pattern of FIG. 3. FIG. 4 shows that the first measurement scale 34 is made up of a set of graduations 42 that mark respective corner positions that are offset, by different distances, away from the true position (31) of the corner of the calibration pattern where this instance of the first measurement scale 34 is located. The graduations 42 in each first measurement scale are parallel to one another.

In the example of FIG. 4 the graduations 42 in the first measurement scale 34 are a set of L-shaped graduations, the limbs of each L-shape are parallel to the edges of the calibration pattern and the angle of each L-shape is directed towards the corner of the calibration pattern where this instance of the first measurement scale 34 is located.

It can be seen from FIG. 4 that the L-shaped graduations 42 are not necessarily continuous: for example, the angle of the L-shape is absent for certain of the graduations because of numbers 45 that are present in the first measurement scale 34. These numbers 45 are an example of indicia that are used to indicate the distances of certain of the L-shaped graduations from the edges 32 of the calibration pattern 30 or, more generally, to enable a user to differentiate the different graduations from each other (thus, for example, the indicia need not be numbers but could be symbols, or other elements for differentiating the graduations from one another, e.g. printing the graduations in different colours). In the example represented in FIG. 4, every fifth graduation is labelled by a number 45 and the graduations 42 are spaced at regular intervals, but it will be readily appreciated that a greater or lesser proportion of the graduations may be labelled and that the graduations may be spaced apart by irregular intervals if so desired.

In some example implementations the graduations 42 of the first measurement scale 34 are spaced apart from one another by an amount that corresponds to a standard unit of measurement (e.g. a millimeter) and the numbers 45 that label the graduations may indicate the number of millimeters that separate the limbs of the relevant graduation 42 from the edges 32 of the calibration pattern. In such implementations it is particularly simple to make adjustments to correct for misalignment that is detected using the first measurement scales 34.

When the calibration pattern 30 that includes first measurement scales 34 as described above is printed on a recording medium sheet, if there is no internal printing skew then the outermost possible corner lines of first measurement scales 34 that are printed in corners that are at different sides of the recording medium in the direction transverse to the transport direction of the recording medium through the printer are fully visible on the printed output. In other words, these corners of the recording medium sheet are reference points that are both in registration with the outermost possible graduations of the first measurement scales 34.

Furthermore, in this example the graduations indicating the first measurement scale are L-shaped, and include a line that is parallel to an edge of the calibration pattern that extends in the media-advance direction and a line that is parallel to an edge of the calibration that extends in the direction transverse to the media-advance direction. So, (ignoring cutting skew for the time being) when there is no printing skew then these lines in the graduations will be parallel to the edges of the recording medium sheet and this situation can be recognized rapidly by visual inspection.

Moreover if, in addition to lack of internal printing skew, the length of the recording medium sheet conforms to its specification then the outermost possible corner lines would be fully visible for first measurement scales 34 that are printed in all corners of the recording medium.

On the other hand, if there is significant internal printing skew then the outermost possible corner lines of the first measurement scales 34 may not be visible or, depending on the nature of the skew, may be visible only at certain corners of the recording medium sheet and not at others. In other words, in this case different corners of the recording medium sheet are in registration with different graduations of their respective first measurement scales 34. Further, in this case both of the limbs in the L-shaped graduations are angled relative to the adjacent edges of the recording medium sheet, instead of being parallel to the edges. So, the existence of skew can be detected simply and rapidly by visual inspection.

It may be the case that there is no printing skew but there is cutting skew (i.e. the cutting mechanism is not cutting perpendicular to the length of the roll). The cutting skew can be detected via printing of a calibration pattern such as that of FIG. 3 because, looking at the L-shaped graduations in the first measurement scales printed on the recording medium sheet, one limb of the L is parallel to the sheet edge in the media advance direction, but the other limb of the L is not parallel to the sheet edge in the cutting direction (direction transverse to the media-advance direction).

A case where both cutting skew and printing skew exist concurrently can be tackled, as follows:

first a blank image is printed by the printer on a recording medium sheet that has been cut by the cutting mechanism, and the angle of cutting is measured (e.g. manually). If the angle of cutting is not 90°, then the cutting mechanism is adjusted (if desired this process can be repeated, until negligible cutting skew is detected)

then the method of FIG. 2 is implemented to print a calibration pattern, for example as illustrated in FIG. 3. and printing skew can now be detected by inspection of the printed calibration pattern.

In the example calibration pattern illustrated in FIG. 3 there is a first measurement scale at each of the corners 31 of the calibration pattern 30. This arrangement facilitates detection of many different misalignment configurations. However, in some implementations first measurement scales 34 are provided only at selected corners of the calibration pattern (e.g. two adjacent corners, or two diametrically-opposite corners).

The foregoing paragraphs refer to the "outermost possible" graduations in the first measurement scales in view of the fact that certain printers do not have "full bleed" capabilities (i.e. they cannot print right up to the edge of the recording medium sheet).

The method of FIG. 2 may be extended (S104) to include performing corrective adjustments in the printer 10 to adjust the relative position between the printer and recording media sheets (in translation and/or rotation), based on the graduations of the first measurement scales 34 that are printed at reference locations at the corners of the recording medium sheet.

In a system that includes a cutting mechanism for cutting, from a roll, recording media sheets to be printed by the printer, an error in the setting of the cutting mechanism may lead to the length Of the recording medium sheets being too long or too short. These conditions can be detected by comparing the graduations of the first measurement scales that are printed in registration with corners of the recording medium sheet that are at opposite ends of the sheet. The method of FIG. 2 may be extended (S104) to include performing corrective adjustments in the cutting position of the cutting mechanism based on the graduations of the first measurement scales that are printed at reference locations at the corners of the recording medium sheet.

Figure 5:
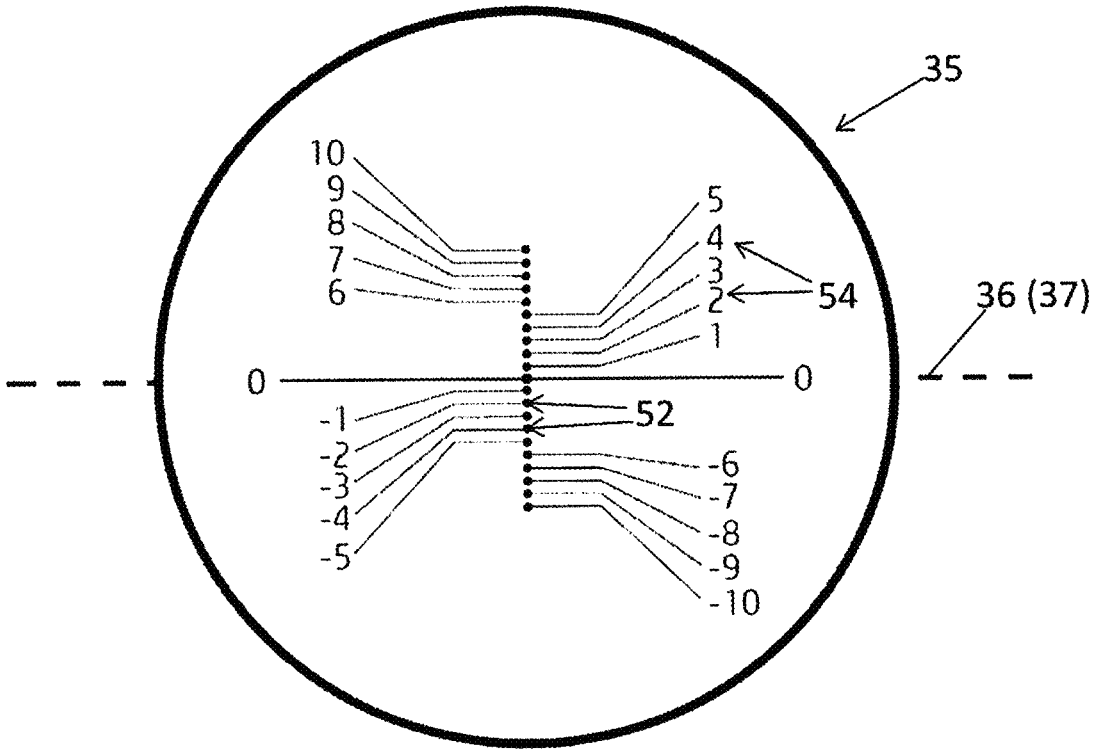
FIG. 5 is an enlarged view of a second measurement scale included in the calibration pattern of FIG. 3.

FIG. 5 is an enlarged view of a second measurement scale 35 used in the example calibration pattern 30 of FIG. 3. At least two of these second measurement scales are provided extending across a line 36 (or 37) in the calibration pattern that corresponds to an intended fold position of the recording medium sheet. FIG. 5 shows that each instance of the second measurement scale 35 is made up of an array of graduations 52 each of which marks a respective position that is offset away from the line 36, 37 in the calibration pattern by different amounts in a direction perpendicular to said line.

In the example of FIG. 5 the graduations 52 in the second measurement scale 35 are spaced at regular intervals from one another and the second measurement scale has indicia 54 indicating the distances of certain of the graduations 52 from the associated line 36, 37 in the calibration pattern. FIG. 5 illustrates a case where each graduation is marked using a dot and the position of each dot is labelled by a number starting at 0 (for the dot that is located on the line 36, 37) and then running from 1 to 10 and −1 to −10 on either side of the line 36, 37 as the distance from the line increases.

The second measurement scales 35 make it possible to detect when there is misalignment between a printer printing the calibration pattern and a subsequent folding apparatus that folds the recording medium sheet bearing the printed calibration image. The detection process may be better understood from a more detailed consideration of the reference graphic 39 of FIG. 3

FIG. 6A provides a first enlarged view of the reference graphic 39. As illustrated in FIG. 6A, the reference graphic 39 includes a first diagram 39*a* which illustrates that the printer and folding apparatus are in correct alignment when two reference points located on a fold in the recording medium are in registration with matching graduations in two second measurement scales 35 that are printed on the sheet and extend across the fold. In this situation the physical fold in the recording medium is parallel to the linear position on the calibration pattern where the fold line was expected.

As shown in FIG. 6A, the second diagram 39*b* of the reference graphic 39 illustrates two different cases of misalignment between a printer 110 and a folding apparatus 120, in a case where hooks 22*a* and 22*b* interconnect the printer 110 and folding apparatus 120 and the hooks 22*a*, 22*b* can be adjusted rightwards or leftwards to alter the relative angle between these devices.

FIG. 6B shows an enlarged view of diagram 39*b*. The left-hand portion of FIG. 6B illustrates a case where the actual position of a physical fold F in the recording medium is at a negative angle relative to a line 36*a* of the calibration pattern where the fold was expected to be (if alignment had been perfect). This angle can be detected using first and second instances (35*b*, 35*a*) of the second measurement scale printed across the expected position 36*a* of the fold line. Because the actual fold F is at an angle to the expected position 36*a*, the fold line F crosses the first 35*b* and second 35*a* instances of the measurement scale at positions that correspond to different graduations on the scale. To compensate for the misalignment indicated in the left-hand portion of FIG. 6B it is appropriate to slide the hooks 22*b*, 22*a* towards the left as indicated in pictorial form in the top left part of the diagram 39*b*.

The right-hand portion of FIG. 6B illustrates a case where the actual position of a physical fold F in the recording medium is at a positive angle relative to the line 36*a* of the calibration pattern where the fold was expected to be (if alignment had been perfect). Again this angle can be detected using the first and second instances (35*b*, 35*a*) of the second measurement scale and noting the difference between the graduations that are in registration with the fold F at the two reference positions where the second measurement scales are located. To compensate for the misalignment indicated in the right-hand portion of FIG. 6B it is appropriate to slide the hooks 22*b*, 22*a* towards the right as indicated in pictorial form in the top right part of the diagram 39*b*.

From FIGS. 6A and 6B it will be understood that a given angular error between the physical fold F in the recording medium and the intended fold position 36*a* produces a larger difference between the values of the graduations (in the different instances 35*b*, 35*a* of the second measurement scale) that are in registration with the fold F as the separation between the instances 35*b*, 35*a* of the second measurement scale increases. Thus, misalignment can be detected with greater sensitivity when the different instances of the second measurement scale located on a common fold line are towards the extremities of the fold line.

As indicated above misalignment can be detected with greater sensitivity when the different instances of the second measurement scale located on a common fold line are spaced further apart from each other. Printing the calibration pattern on a large-format recording medium sheet (e.g. DIN A0 as mentioned above) can enable a greater distance between the instances of the second measurement scale and, thus, greater sensitivity in detection of misalignment.

In the vast majority of cases a misalignment that affects one fanfold produces substantially the same effect on all of the fanfolds, so it is sufficient if second measurement scales are provided across just one of the fanfold line positions. However, it is possible that unusual cases may exist where different physical fanfolds have different displacements from their intended positions. To cater for cases of that type the calibration pattern may include instances of the second measurement scale on every fold line position.

The method of FIG. 2 may be extended (S103) to include performing a diagnosis of misalignment by folding the printed recording medium sheet (using the folding apparatus) and determining where reference points along the fold lie relative to the graduations of second measurement scales that are printed across the expected position of the fold line. The method of FIG. 2 may further be extended (S104) to include performing a corrective adjustment of the alignment between the printer and the folding apparatus based on the graduations of the second measurement scales that are in registration with the reference locations that are spaced along the fold.

The second measurement scales 35 make it possible to detect internal folding skew when the printer 10 and folding apparatus 20 are in an offline configuration. The printer 10 may print the calibration pattern 30 on a recording medium sheet and then the user, a service engineer, or the like, may manually feed the sheet into the folding apparatus, taking care to ensure that the sheet is fed correctly into the folding apparatus (i.e. it is fed in at the correct orientation). In this case, after the folding apparatus 20 has folded the recording medium sheet the folds F in the folded package should be parallel to linear portions 36, 37 of the calibration pattern (as in diagram 39*a*) if there is no internal folding skew. On the other hand, if there is internal folding skew then this can be detected because reference points along the fold F will be in registration with different graduations in the second measurement scales 35*a*,35*b* that extend across the fold line position (as in diagram 39*b*).

In this case also, the method of FIG. 2 may be extended (S104) to include performing a corrective adjustment of folding parameters of the folding apparatus based on the graduations of the second measurement scales that are in registration with reference locations positioned along a common fold of the folded sheet.

The description above explains how various types of misalignment can be detected using various calibration patterns including measurement scales. The specific example calibration pattern illustrated in FIG. 3 comprises the first and second measurement scales 3 and is a single pattern that allows plural different types of misalignment to be detected. None of the markings in this example calibration pattern are linguistic, they are all symbolic or numerical, thus the same calibration sheet is comprehensible to users irrespective of the languages they may understand.

Figure 7:
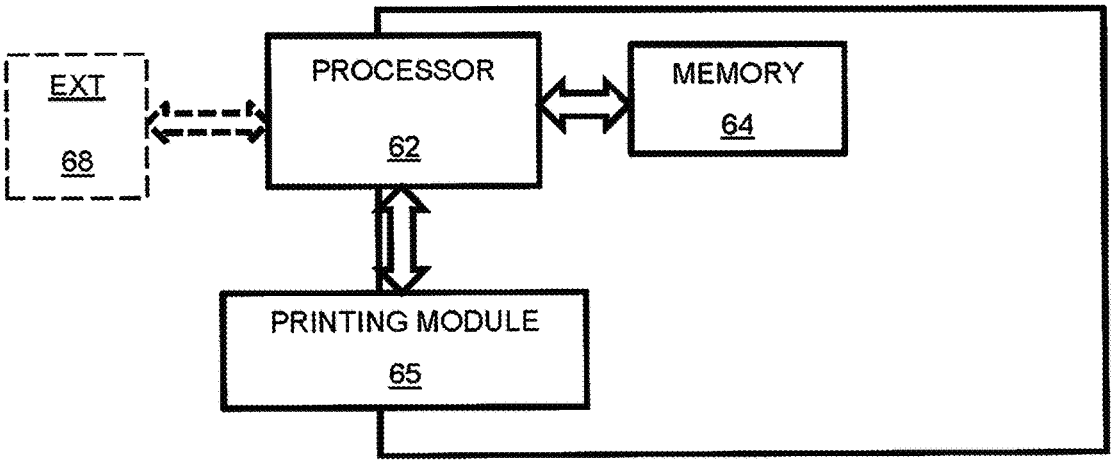
FIG. 7 is a block diagram illustrating components in an example printer.

FIG. 7 illustrates an example printer that may be used in implementing the method of FIG. 2. The printer 10 includes a processor 62, memory 64 (which may, for example, be non-volatile memory, firmware, etc. storing machine-readable instructions that are executable by the processor 62 to receive a request to print a calibration pattern on a recording medium, and responsive to reception of the request, print a calibration pattern including graduated measurement scales positioned so that: when the calibration pattern is printed without misalignment on a recording medium sheet of predetermined dimensions, matching graduations of plural measurement scales in the calibration pattern are printed at respective reference locations on the recording medium sheet that correspond to corners of the recording medium sheet or to spaced positions along a line where folding of the recording medium sheet is scheduled, and when the calibration pattern is printed with misalignment on a recording medium sheet of predetermined dimensions, non-matching graduations of said plural measurement scales are printed at the reference locations on the recording medium sheet.

For example, the instructions stored in memory 64 may cause the processor 62 to control a printing module 65 of the printer 10 to print a calibration pattern that either is stored locally to the printer or acquired via communication with an external module 68. The calibration pattern may be a pattern according to the examples described above.

Figure 8:
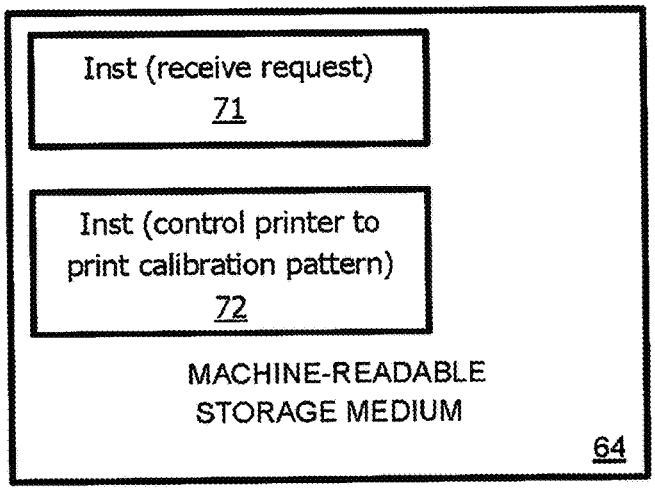
FIG. 8 is a schematic representation of an example computer-readable storage medium.

FIG. 8 illustrates an example machine-readable storage medium 64 that is encoded with machine-readable instructions 71, 72 executable by a processor (such as the processor 62 of FIG. 7). The machine-readable storage medium 64 comprises instructions 71 to receive a request to print a calibration pattern on a recording medium, and instructions 72 to print, in response to reception of said request, a calibration pattern including graduated measurement scales positioned so that when the calibration pattern is printed without misalignment on a recording medium sheet of predetermined dimensions, matching graduations of plural measurement scales in the calibration pattern are printed at respective reference locations on the recording medium sheet that correspond to corners of the recording medium sheet or to spaced positions along a line where folding of the recording medium sheet by the folding apparatus is scheduled, and when the calibration pattern is printed with misalignment on a recording medium sheet of predetermined dimensions, non-matching graduations of said plural measurement scales are printed at the reference locations on the recording medium sheet.

Although the present document describes various implementations of example methods, devices and storage media, it will be understood that the present disclosure is not limited by reference to the details of the specific implementations and that, in fact, variations and adaptations may be made within the scope of the appended claims.

For example, FIG. 3 illustrates a particular example of a calibration pattern but other calibration patterns which differ from the example of FIG. 3 in features including but not limited to the number of instances of the different types of measurement scale, and the markings used to indicate graduations in the measurement scales.

Figure 9:
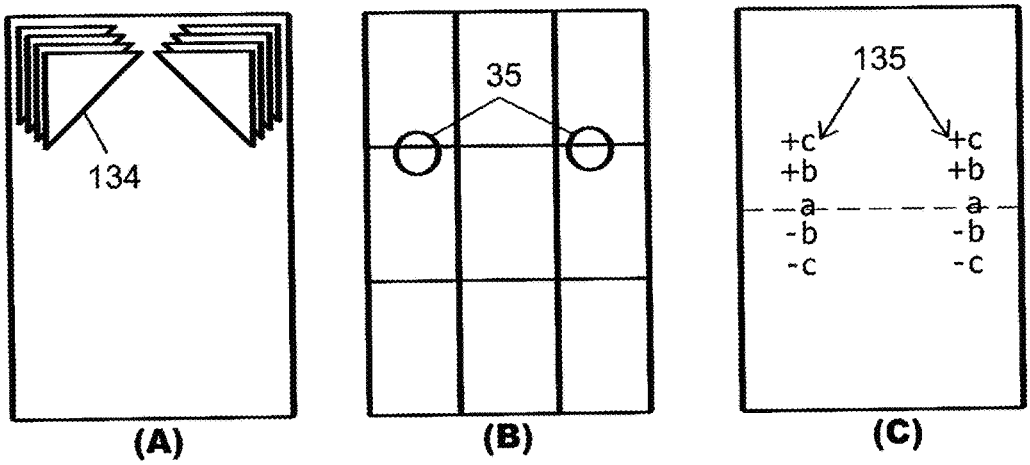
FIG. 9 is a diagram representing some additional example calibration patterns.

For the purposes of illustration but not limitation, FIG. 9 illustrates schematically some further examples of calibration patterns that may be used. Image (A) in FIG. 9 illustrates the case of a calibration pattern that includes two first measurement scales 134 located at two corners of the calibration pattern, but no second measurement scales, and the graduations in the first measurement scales 134 are marked using overlapping triangles rather than L-shaped markings. Image (B) in FIG. 9 illustrates the case of a calibration pattern that only includes second measurement scales 35 provided on one out of plural lines that correspond to intended fold-lines of the recording medium (and no first measurement scales are provided). Image (C) in FIG. 9 illustrates the case of a calibration pattern that includes two second measurement scales 135 whose graduations are marked using letters and the letters change progressively through the alphabet as the relevant graduation is further away from the position of the intended fold-line.

Moreover, features of the various example methods, devices and storage media described above may be combined with one another in substantially any combinations and sub-combinations.

Furthermore, in FIGS. 1 and 7, different numbers of components, modules, or entities than depicted may be used. Additionally, individual functions that are described as being performed by multiple different entities may be performed by a single entity and, likewise, functions that are described as being performed by a single entity may be distributed between plural entities (of the same or different types).

The invention claimed is:

1. A method for detecting misalignment in a system including a printer and a folding apparatus, the method comprising:

receiving, at the printer, a request to print a calibration pattern on a recording medium sheet; and in response to the request, printing the calibration pattern on the recording medium sheet, the calibration pattern including graduated measurement scales located at corners of the calibration pattern, each measurement scale including a set of graduations marking respective corner positions that are offset, by different distances, from a true position of the corner of the calibration pattern, the graduations in each measurement scale parallel to one another, the graduated measurement scales positioned so that:

when the calibration pattern is printed without misalignment on the recording medium sheet, matching graduations of the measurement scales in the calibration pattern are printed at respective reference locations on the recording medium sheet that correspond to corners of the recording medium sheet or to spaced positions along a line where folding of the recording medium sheet by the folding apparatus is to occur, and when the calibration pattern is printed with misalignment on the recording medium sheet, non-matching graduations of the measurement scales are printed at the reference locations on the recording medium sheet.

2. The misalignment detection method according to claim 1, wherein a first measurement scale of the measurement scales includes a set of L-shaped graduations, with limbs of each L-shape being parallel to edges of the calibration pattern and an angle of each L-shape being directed towards the corner of the calibration pattern where the first measurement scale is located.

3. The misalignment detection method according to claim 2, wherein the L-shaped graduations in the first measurement scale are spaced at regular intervals from one another and the calibration pattern includes indicia indicating the distances of certain of the L-shaped graduations from the edges of the calibration pattern.

4. The misalignment detection method according to claim 1, wherein there is a measurement scale at each of the corners of the calibration pattern.

5. The misalignment detection method according to claim 1, further including adjusting a relative position between the printer and recording media sheets, in translation and/or rotation, based on the graduations of the measurement scales that are printed at the reference locations at the corners of the recording medium sheet.

6. The misalignment detection method according to claim 1, wherein the system further includes a cutting mechanism to cut, from a roll, the recording media sheets to be printed by the printer, the method further including adjusting a cutting position of the cutting mechanism based on the graduations of the measurement scales that are printed at the reference locations at the corners of the recording medium sheet.

7. A method for detecting misalignment in a system that includes a printer and a folding apparatus, the method comprising:

in response to a request to print a calibration pattern on a recording medium sheet, printing the calibration pattern on the recording medium sheet, the calibration pattern including measurement scales that are located at respective positions that are spaced along a line in the calibration pattern that corresponds to a fold line where folding of a recording medium sheet by the folding apparatus is to occur, measurement scales respectively including a set of graduations marking respective fold positions that are offset from the fold line in the calibration pattern by different amounts in a direction perpendicular to the fold line, the measurement scales positioned so that:

when the calibration pattern is printed without misalignment on the recording medium sheet, matching graduations of the measurement scales in the calibration pattern are printed at respective reference locations on the recording medium sheet that correspond to corners of the recording medium sheet or to spaced positions along a line where folding of the recording medium sheet by the folding apparatus is to occur, and when the calibration pattern is printed with misalignment on the recording medium sheet, non-matching graduations of the measurement scales are printed at the reference locations on the recording medium sheet.

8. The misalignment detection method according to claim 7, wherein the graduations in a first measurement scale of the measurement scales are spaced at regular intervals from one another and the calibration pattern includes indicia indicating distances of certain of the graduations from the fold line in the calibration pattern.

9. The misalignment detection method according to claim 7, wherein the calibration pattern includes: (a) a plurality of that correspond to respective fold lines where folding of the recording medium sheet by the folding apparatus is to occur, and (b) at least a pair of the measurement scales on each of the lines.

10. The misalignment detection method according to claim 7, further including adjusting a relative angular position between the printer and the folding apparatus based on the graduations of the measurement scales that are printed at reference locations positioned along a common fold of the folded sheet.

11. The misalignment detection method according to claim 7, further including folding the printed recording medium sheet by the folding apparatus, and adjusting the folding parameters of the folding apparatus based on the graduations of the measurement scales that are printed at reference locations positioned along a common fold of the folded sheet.

12. The misalignment detection method according to claim 7, wherein the calibration pattern includes fold-line indicators marking linear positions in the calibration pattern that correspond to respective fold lines where folding of the recording medium sheet by the folding apparatus is to occur.

13. A printer comprising:

a processor;

memory; and machine-readable instructions stored in the memory, when executed, the instructions are to cause the processor to:

respond to a request to print a calibration pattern on a recording medium sheet by printing the calibration pattern, the calibration pattern including graduated measurement scales located at corners of the calibration pattern, the graduated measurement scales including a set of graduations marking respective corner positions that are offset, by different distances, from a true position of the corner of the calibration pattern, and the graduations in the graduated measurement scales being parallel to one another, the graduated measurement scales positioned so that:

when the calibration pattern is printed without misalignment on the recording medium sheet, matching graduations of the graduated measurement scales in the calibration pattern are printed at respective reference locations on the recording medium sheet that correspond to corners of the recording medium sheet or to spaced positions along a line where folding of the recording medium sheet is to occur, and when the calibration pattern is printed with misalignment on the recording medium sheet, non-matching graduations of the graduated measurement scales are printed at the reference locations on the recording medium sheet.

14. The printer according to claim 13, further including a user interface responsive to user operation to generate the request to print the calibration pattern on the recording medium.

* * * * *